US007503563B2

(12) United States Patent
Bowman

(10) Patent No.: US 7,503,563 B2
(45) Date of Patent: Mar. 17, 2009

(54) COMBINED GIFT CONTAINER AND KINETIC PUZZLE

(75) Inventor: Linden H. Bowman, Ellicott City, MD (US)

(73) Assignee: The Lindy Bowman Company, Elkridge, MD (US)

( * ) Notice: Subject to any disclaimer, the term of this patent is extended or adjusted under 35 U.S.C. 154(b) by 451 days.

(21) Appl. No.: 11/268,476

(22) Filed: Nov. 8, 2005

(65) Prior Publication Data

US 2006/0226601 A1 Oct. 12, 2006

Related U.S. Application Data

(60) Provisional application No. 60/625,575, filed on Nov. 8, 2004.

(51) Int. Cl.
*A63F 9/00* (2006.01)
*A63F 7/04* (2006.01)

(52) U.S. Cl. ..... 273/108; 273/118 R

(58) Field of Classification Search ..... 273/108, 273/109, 113, 115, 116, 118 R, 119 R, 121 R, 273/236, 285, 148 R; 446/76; 206/776, 206/216; 220/521; 229/116.5
See application file for complete search history.

(56) References Cited

U.S. PATENT DOCUMENTS 570,858 A * 11/1896 Henry ..... 273/113
746,612 A 12/1903 Wade
777,205 A * 12/1904 Curtis ..... 273/115
2,563,608 A * 8/1951 Laufer ..... 273/109
2,643,811 A 6/1953 Bolding
2,742,291 A * 4/1956 Simon ..... 273/113
2,792,696 A * 5/1957 Stayart ..... 215/11.1
2,799,391 A 7/1957 Eisner
3,188,040 A * 6/1965 Eichler ..... 248/346.11
3,517,936 A * 6/1970 Hicks et al. ..... 273/115
3,964,748 A * 6/1976 Harvey, Jr. ..... 273/145 C
4,007,936 A * 2/1977 Hornsby, Jr. ..... 273/115
4,239,223 A * 12/1980 Wilson ..... 463/48
5,280,908 A * 1/1994 Lu ..... 273/121 R
5,289,917 A 3/1994 Chabria
5,310,184 A * 5/1994 Grist ..... 273/153 R
5,314,181 A * 5/1994 Lin ..... 273/109
5,375,828 A * 12/1994 Shikami ..... 273/110
5,379,886 A 1/1995 Brauner et al.
5,692,613 A 12/1997 Opdyke
5,718,335 A 2/1998 Boudreaux
5,775,494 A 7/1998 Taplin
5,967,307 A 10/1999 Wang
6,070,719 A 6/2000 Pollock
6,173,833 B1 1/2001 Strehlow
6,823,988 B2 11/2004 Ryan et al.
7,285,034 B2 * 10/2007 Kay et al. ..... 446/73
2006/0226601 A1 * 10/2006 Bowman ..... 273/236

* cited by examiner

*Primary Examiner*—Raleigh W. Chiu
(74) *Attorney, Agent, or Firm*—Cahn & Samuels, LLP

(57) ABSTRACT

A gift container includes a base and a lid capable of holding a gift. The gift container also includes an integral manipulable game.

20 Claims, 8 Drawing Sheets

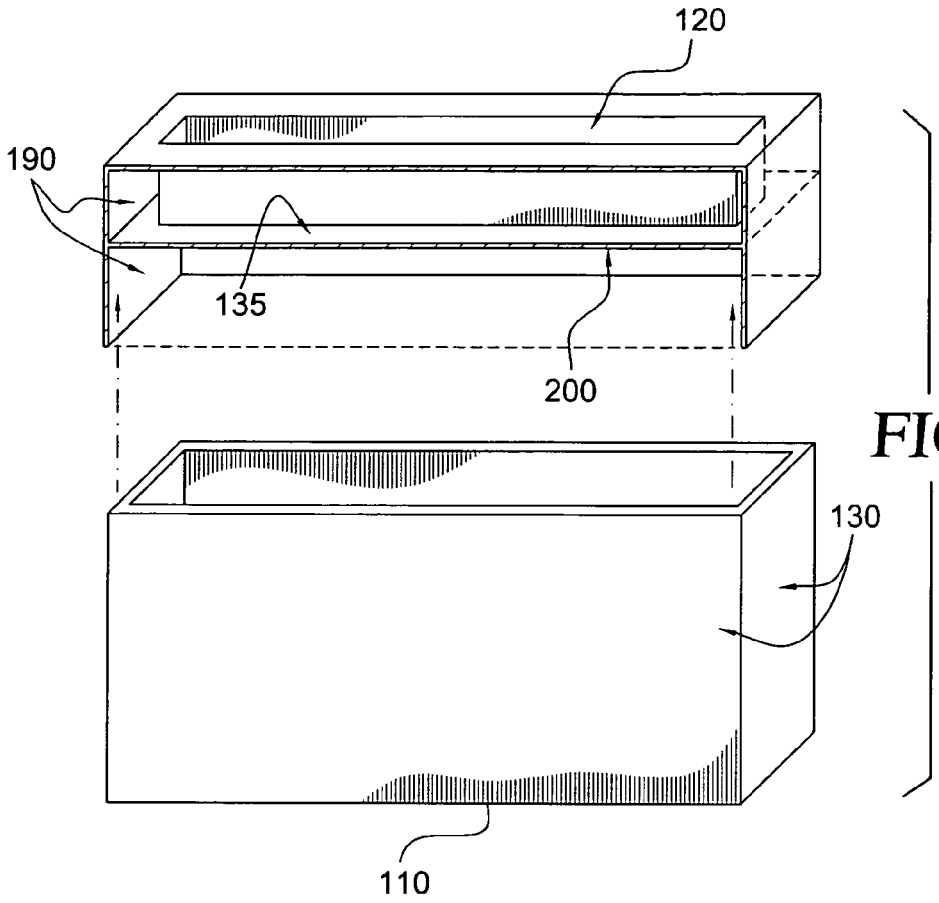
FIG. 12
FIG. 13
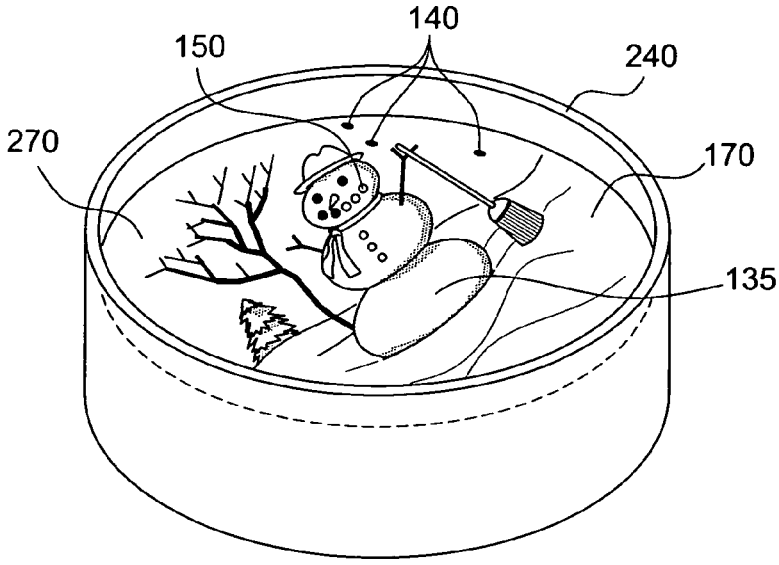

COMBINED GIFT CONTAINER AND KINETIC PUZZLE

I. RELATED APPLICATIONS

This application is an application filed under 35 U.S.C. §111(a) claiming benefit pursuant to 35 U.S.C. § 119(e)(1) of the filing date of the Provisional Application 60/625,575 filed on Nov. 8, 2004 pursuant to 35 U.S.C. § 111(b), the entire contents of which are incorporated herein by reference.

II. FIELD OF THE INVENTION

This invention relates to an improvement to the traditional gift container comprising an interactive kinetic game contained in a windowed chamber within the gift container.

III. BACKGROUND OF THE INVENTION

Traditionally, gift containers, boxes for example, consist of a simple container and a lid. A gift container might also display decorations such as printing or graphics on the exterior surfaces. To enhance their appearance, gift containers are also used in combination with other features such as gift wrapping, ribbons, bows, or a card.

Ornamental printing or graphics on a gift container or its wrapping add to the gift-giving experience by way of visual stimulation. However, they do not involve the physical skill of the recipient. Combining a gift container with a game visible from the container's exterior and requiring physical/kinetic manipulation by the recipient (a maze or puzzle using small ball-shaped members, for example) enhances the gift-giving experience and cultivates hand-eye coordination.

Typically a recipient merely opens the container, retrieves the gift, and straight-away disposes of the container. But the gift-giving and gift-receiving experience may be made more interesting and entertaining. For example, Christmas gifts typically sit under a Christmas tree for many days or weeks prior to being opened. Incorporation of an externally visible interactive packaging feature invites legitimate exploration of the container by permitting a person to "shake" or "play with" the container during the days (or weeks) prior to opening.

Gift containers typically serve a single use function of housing a gift item. After opening, such containers are either discarded or, if of adequate integrity, stored for use on another occasion. However, the container/package, itself, possesses little or no intrinsic entertainment value, which minimizes the likelihood of a recipient keeping the container for other uses.

Some containers used for packaging commercial items contain transparent windows displaying the item being sold (for example, the label of an alcoholic beverage). In some instances, the container includes a windowed chamber holding one of multiple separate items, thereby allowing the purchaser to view the separate items. Typically, the separate visible item is used to promote or complement the primary item within the container. The windowed chamber is opened and the promotional or complimentary item removed. For example, a roll of film might be displayed in the container for a camera. These prior art containers do not contemplate a discrete, independent windowed chamber containing an interactive manipulable, kinetic game.

In some instances, the item being sold can be manipulated by the purchaser. For example, a toy or action figure may be visible through a transparent window and may include an opening for access to an actuating button.

IV. SUMMARY OF THE INVENTION

It is an object of the invention to overcome shortcomings in the prior art and to enhance the intrinsic entertainment value of a gift package.

It is an object of the present invention to provide a novel gift container with an integrated interactive kinetic game amusement feature.

It is another object of this invention to provide a rigid, self-supporting gift container incorporating a windowed chamber containing an interactive kinetic game.

It is a further object of the present invention to provide a gift container incorporating a kinetic game that is self-contained and does not require manipulation by way of an external device.

The foregoing objects are satisfied at least in part by a gift container comprising: a container base defining select planar dimensions formed by an upper and lower surface and a generally continuous rigid side wall of a first height and select thickness having inner and outer surfaces and projecting substantially orthogonally above said upper container base surface; a lid, defining a cover with a lower surface and an upper surface dimensionally generally conforming to the planar dimension of the container base, said cover incorporating a depending perimeter side wall with an inner wall surface of a height equal to or less than the first height and dimensioned to slide over and register with the outer surface of the container base side wall; a chamber incorporating a manipulable, kinetic game defining a playing surface, a generally continuous rigid side wall of a second height and select thickness having inner and outer surfaces projecting above said playing surface and forming an annulus with the perimeter wall and a viewing portion formed integrally with the outer surface of the container permitting user viewing of the underlying playing surface; and at least one movable member disposed within the chamber for manipulation over said playing surface.

The above-referenced objects are also satisfied at least in part by a gift container comprising: a container base defining select planar dimensions formed by an upper and lower surface and a generally continuous rigid side wall of a first height and select thickness having inner and outer surfaces and projecting substantially orthogonally above said upper container base surface; a lid, defining a cover with a lower surface and an upper surface dimensionally generally conforming to the planar dimension of the container base, said cover incorporating a depending perimeter side wall with an inner wall surface of a height equal to or less than the first height and dimensioned to slide over and register with the outer surface of the container base side wall; a chamber formed integrally with the lid, said chamber incorporating a manipulable, kinetic game defining a playing surface disposed below the upper lid surface, a generally continuous rigid side wall of a second height and select thickness having inner and outer surfaces and projecting above said playing surface and forming an annulus with the depending perimeter wall, the rigid side wall being affixed to the lower surface of the lid cover, and a viewing portion formed integrally with the outer surface of the container permitting user viewing of the underlying playing surface; and at least one movable member disposed within the chamber for manipulation over said playing surface.

As used herein, "gift container" refers to a box, receptacle, encapsulation or enclosure such as a rigid set-up box, a cylindrical/tubular package, or any other appropriately configured, sturdy construct used to contain at least one gift item.

As used herein, "kinetic game" refers to a self-contained game, puzzle or other amusement device incorporating a static or dynamic playing platform affixed within a container in which movable members such as balls or cylinders may be physically manipulated by the user.

As used herein, "windowed chamber" refers to a sealed three-dimensional chamber integrated into a gift container having at least one user-visible portion to thereby allow a user to visually access the kinetic game.

As used herein, "movable member" refers to one or more pieces that can be manipulated by a user and preferably may be moved by tilting the kinetic game to induce sliding or rolling movement. The most typical form of the movable member(s) will be spherical, but can also include other shapes, for example, cylinders and sliding blocks.

As used herein, "substantially," "generally," "relatively" and other words of degree are relative modifiers intended to indicate permissible variation from the characteristic so modified. They are not intended to be limited to the absolute value or characteristic which they modify, but rather possessing more of the physical or functional characteristic than its opposite, and preferably approaching or approximating such a physical or functional characteristic.

In brief, the invention herein contemplates combining an interactive game with the gift container providing an enhanced gift-giving experience by providing an entertainment functionality. The interactive game or puzzle is disposed in a chamber integrally formed with the container that underlies a viewing window to permit user manipulation.

In the following enabling description, reference is made to the accompanying drawings, which are shown by way of illustration of exemplary embodiments in which the invention may be practiced. In the following illustrated embodiments the apparatus should become apparent to a person of ordinary skill in the art and in sufficient detail to enable those skilled in the art to practice the invention. It is to be understood that other embodiments may be used and that structural changes based on presently known structural and/or functional equivalents may be made without departing from the scope of the invention.

V. BRIEF DESCRIPTION OF THE DRAWINGS

FIG. 12 is an assembly view of another embodiment according to the invention.

FIG. 13 is a close-up perspective view of the lid and windowed chamber of the first embodiment.

VI. DETAILED DESCRIPTION OF THE INVENTION

Figure 1:
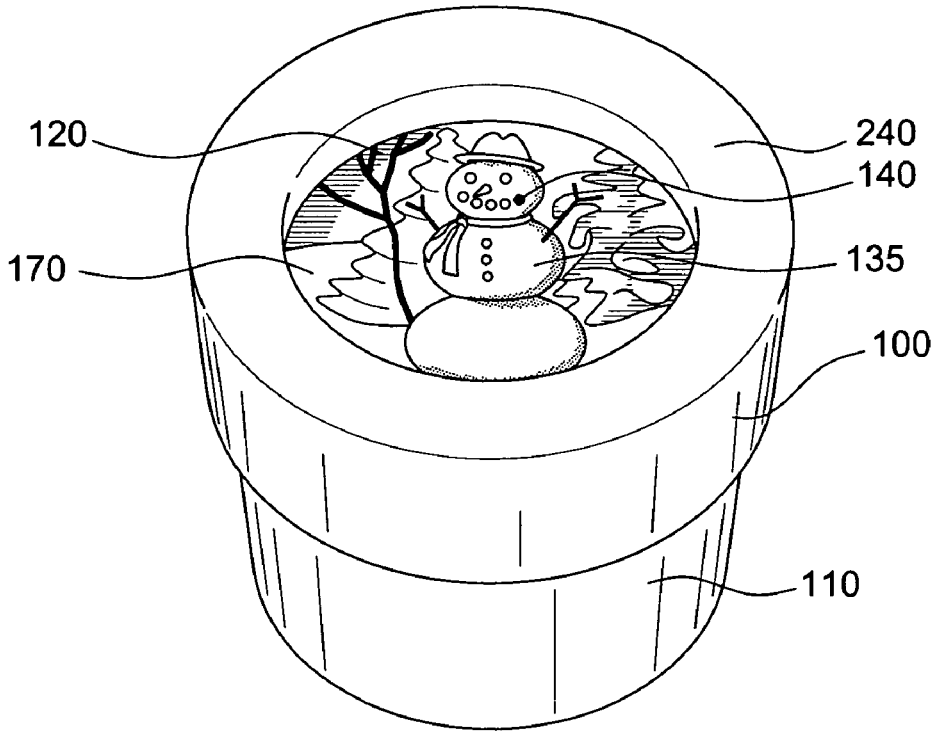
FIG. 1 is a perspective view of a first embodiment of the gift container in cylindrical form with the kinetic game integrated in the lid according to the invention.
Figure 2:
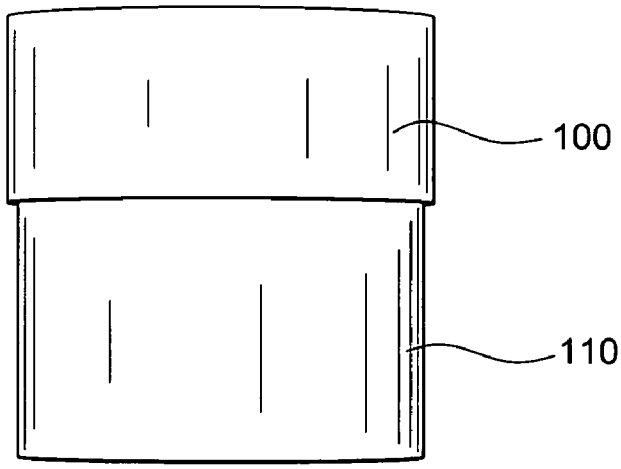
FIG. 2 is a side perspective view of the embodiment of FIG. 1.
Figure 8:
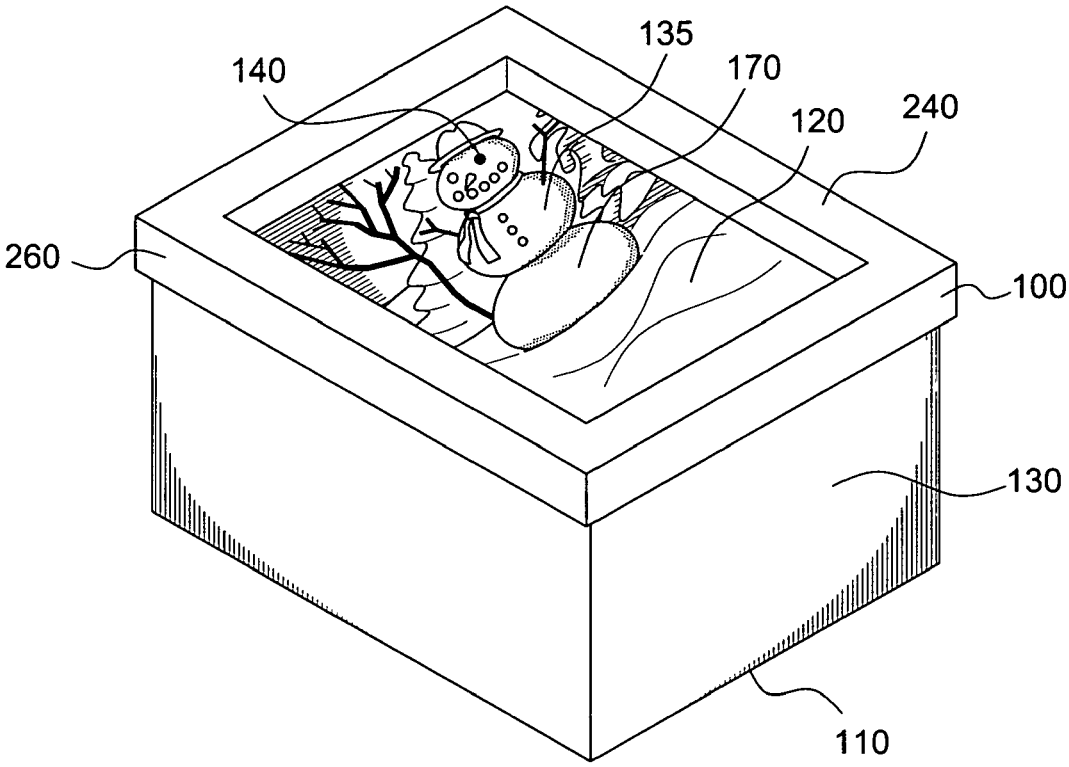
FIG. 8 is perspective view of another embodiment of a gift container in rectangular form with the kinetic game integrated in the lid according to the invention.
Figure 9:
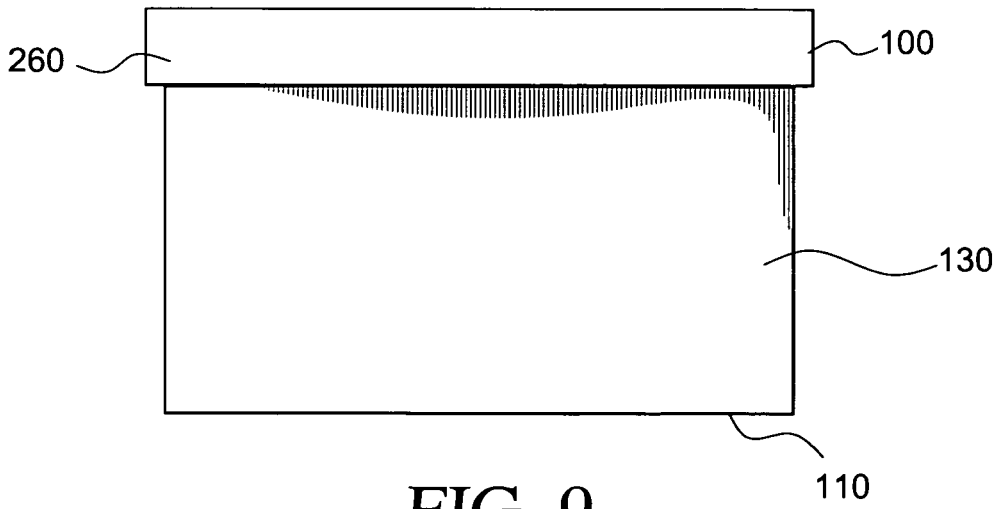
FIG. 9 is an elevational view of the embodiment of FIG. 8.
Figure 10:
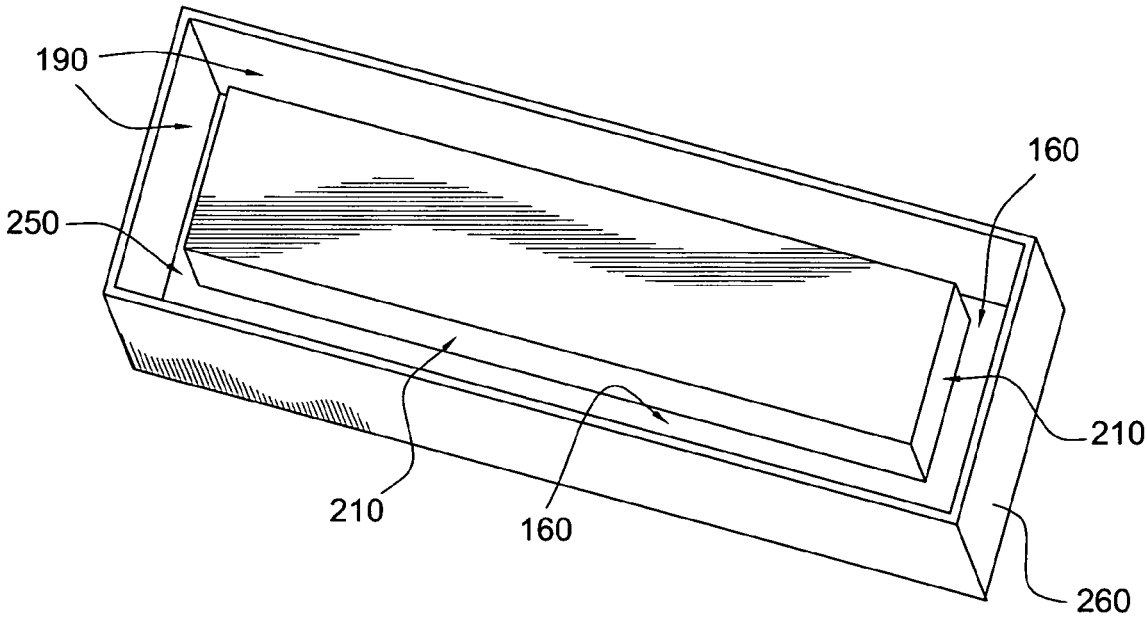
FIG. 10 is a bottom view in perspective of the lid of the embodiment of FIG. 8.

The invention herein is directed to a gift container incorporating a kinetic game within a windowed chamber. Embodiments of the gift container can be of any suitable geometric composition that permits integration of the kinetic game. The embodiment illustrated, for example, in FIGS. 1 and 2 is cylindrical in configuration. The embodiment depicted, for example, in FIG. 8 is a rectangular box.

Figure 3:
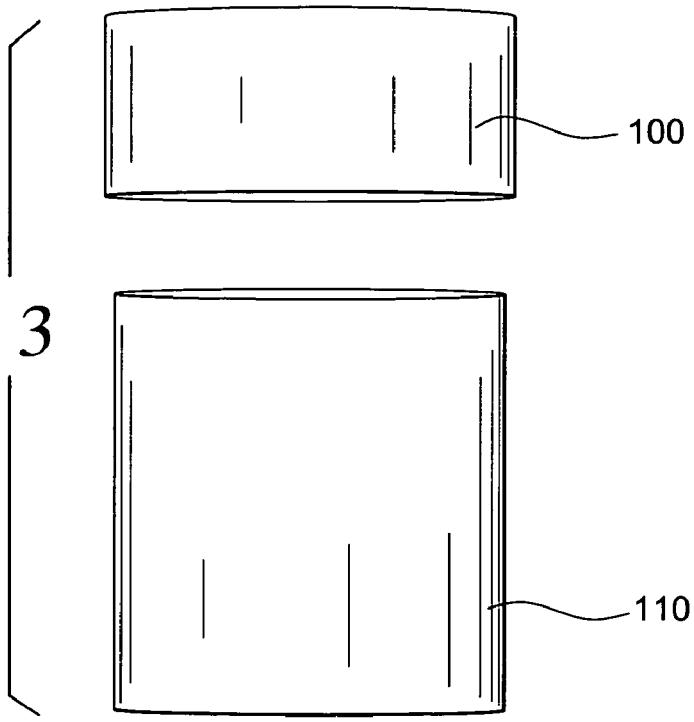
FIG. 3 is a disassembled side view of an open lid and container base of the embodiment of FIG. 1.
Figure 4:
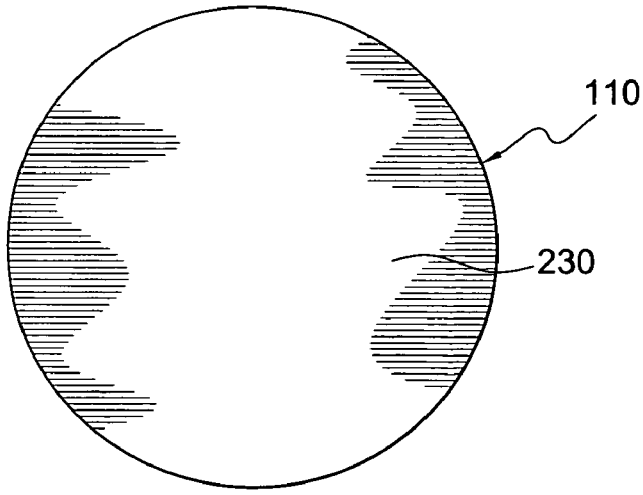
FIG. 4 is a bottom view of the container base of the embodiment in FIG. 1.
Figure 5:
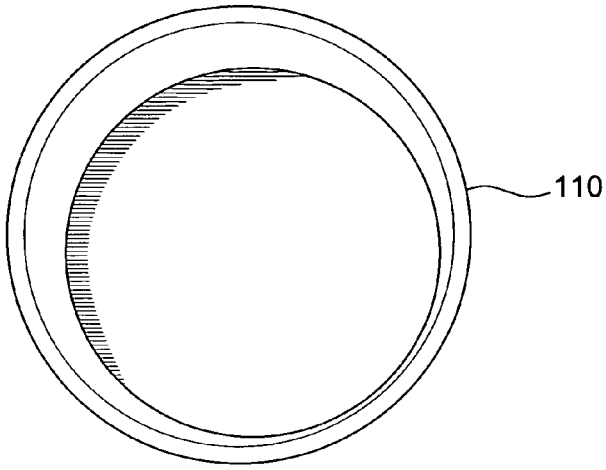
FIG. 5 is a top view of the container base of the embodiment of FIG. 1.

The invention includes a lid 100 and a container base 110. The illustrated container base 110 includes a planar bottom 230 and sides 130 of a select thickness rising substantially orthogonally, all having inner and outer surfaces. The container base 110 is illustrated as cylindrical in FIG. 3 and rectangular in FIGS. 11 and 12.

Figure 11:
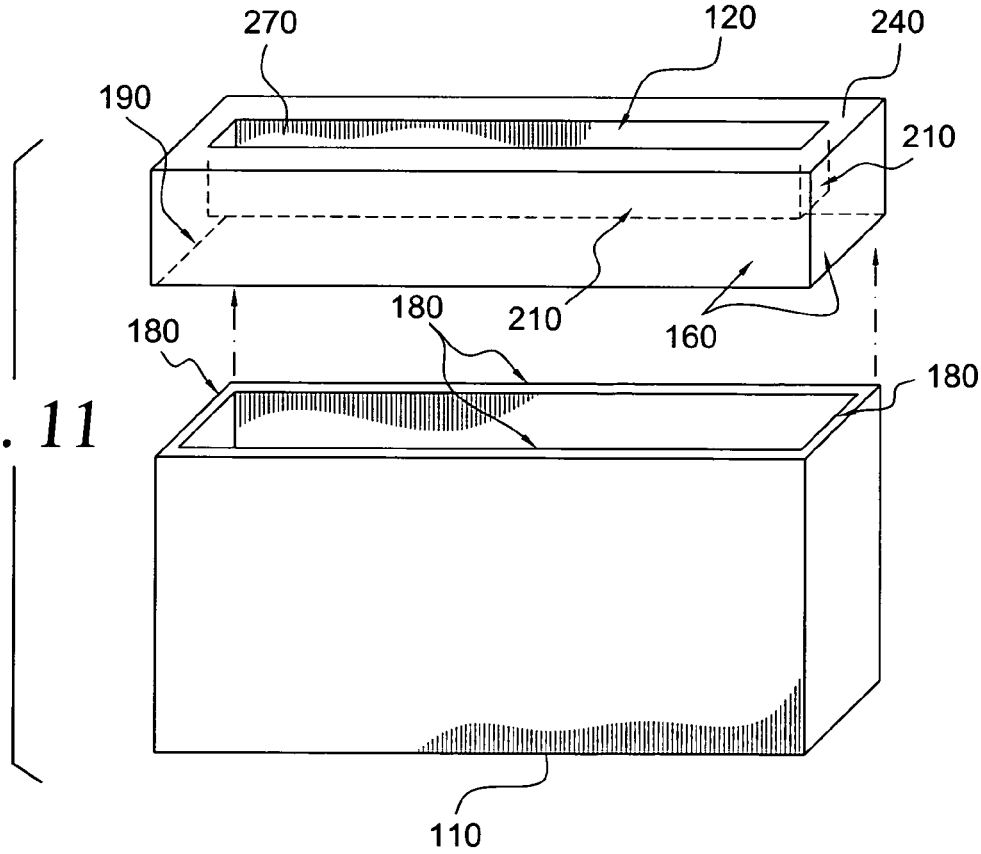
FIG. 11 is an assembly side view of the embodiment of FIG. 8.

The illustrated lids include a cover with an upper surface 240 and a lower surface 250 and a perimeter side wall 260 of a height equal to or less than the side 130 of the container base 110. The other dimensions of the lid 100 are generally conforming to the planar dimensions of the container base 110 and are adequate to slide the lid 100 over the top lip 180 and side 130 of the container base 110, as illustrated in FIGS. 11 and 12, thereby sealing the container and any contents therein. The height of the lid 100 is sufficient to hold the lid 100 in position on the container base 110.

The illustrated containers include a windowed chamber 120 containing a kinetic game 170. The illustrated chambers 120 include a playing surface 135 and a generally continuous side wall 210 of a select thickness with inner and outer surfaces projecting above the playing surface 135. The side wall 210 in at least one embodiment is rigid. The illustrated windowed chambers 120 also include a viewing portion 270 which allows the user to view the underlying playing surface 135. An exemplary material for the viewing portion 270 is a transparent material. The viewing portion 270 is formed integrally with an outer surface of the container.

Figure 15:
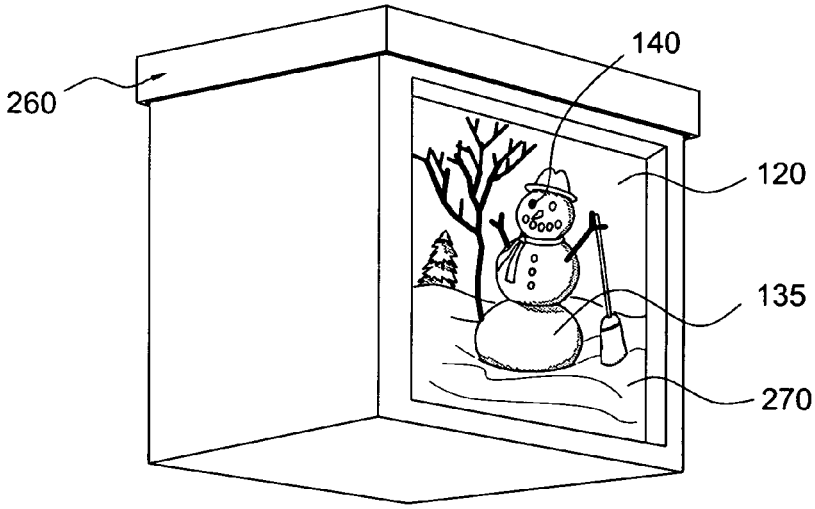
FIG. 15 is a perspective view of a rectangular box embodiment of a gift container with the windowed chamber in the side of the container base.
Figure 16:
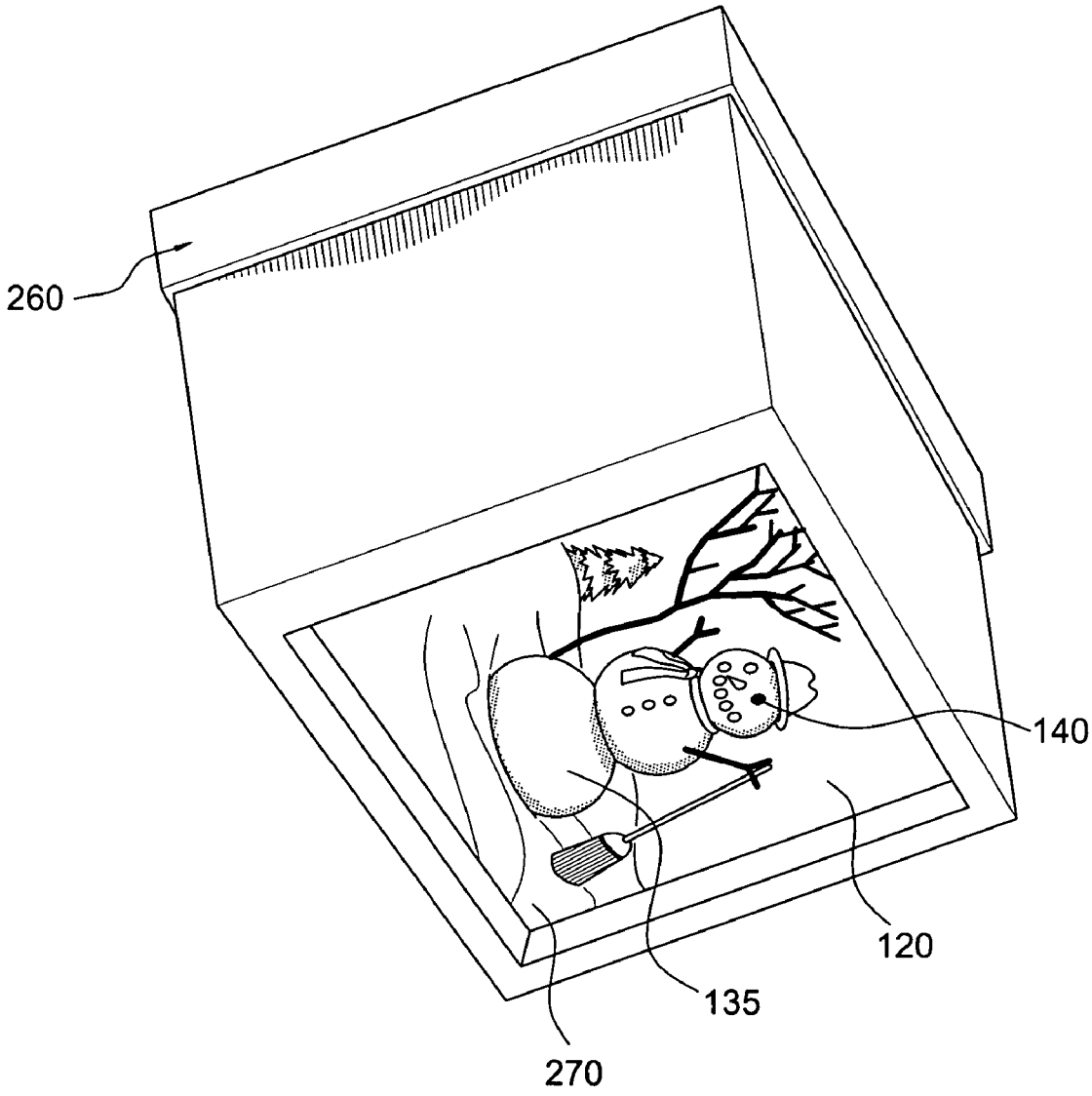
FIG. 16 is a perspective view of a rectangular box embodiment of a gift container with the windowed chamber in the bottom of the container base.

Typically, the windowed chamber 120 is located below the upper surface 240 of the lid 100 with the viewing portion comprising a portion of the upper surface 240 of the lid 100 as illustrated in FIGS. 1, 8, 13, and 14. However, the windowed chamber 120 can also be incorporated into other areas of the container, such as the side 130 of the container base 110 as illustrated, for example, in FIG. 15, or in the bottom 230 of the container base 110 as illustrated, for example, in FIG. 16.

Figure 6:
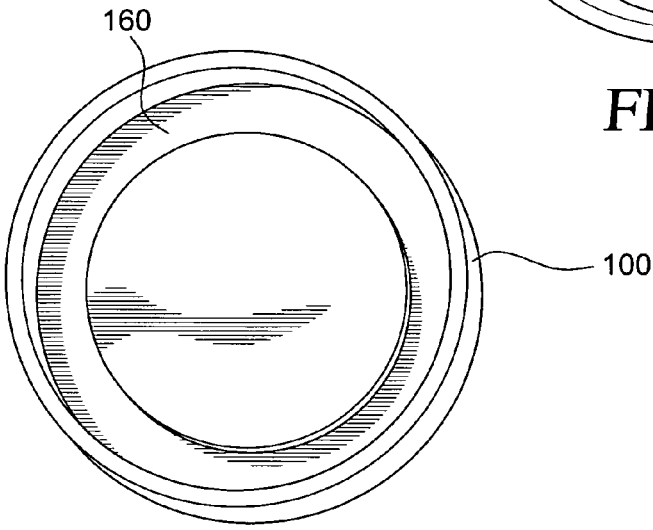
FIG. 6 is a bottom view of the lid of the embodiment of FIG. 1.

In some embodiments, the side wall 210 of the windowed chamber 120 project above the peripheral edge of the playing surface 135. In one embodiment, illustrated in FIGS. 6 and 11, there is an annulus 160 between the external surface of the side walls 210 of the windowed chamber 120 and the interior surface 190 of the side wall 260 of the lid 100. This annulus

160 is capable of receiving the top lip 180 of the side 130 of the container base 110. The container thus can be sealed by friction fit when the container base 110 is inserted into the annulus 160.

Figure 7:
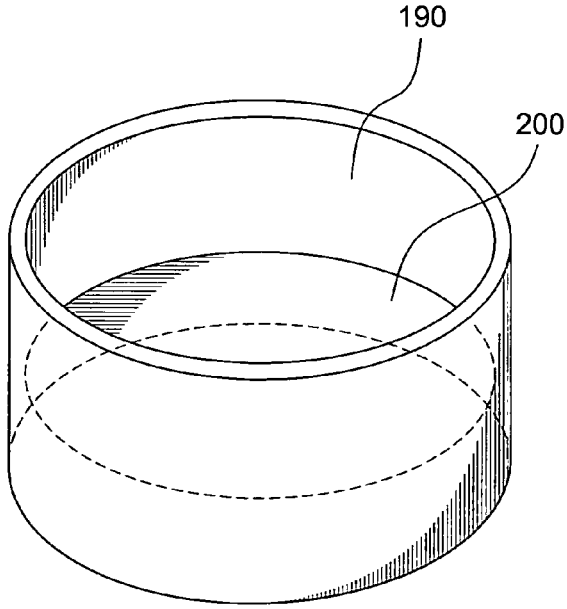
FIG. 7 is a bottom view of an alternative embodiment of the lid for use with the embodiment of FIG. 1 according to the invention.

In a second embodiment, illustrated in FIGS. 7 and 12, the circumference of the playing surface 135 is greater than the circumference of the side wall 210 of the chamber 120. The playing surface 135 therefore extends beyond the side wall 210 of the chamber 120 and attaches to the interior side wall 190 of the lid 100. In this embodiment, the container can be sealed by friction fit between the lower portion of the interior side walls 190 of the lid 100 and the upper portion of the exterior surface of the side 130 of the container base 110. The underside 200 of the playing surface 135 can also rest upon the upper lip 180 of the side 130 of the container base 110. In at least one embodiment, the side wall 210 of the chamber 120 is integrally formed with at least one side wall of the lid 260 or a side 130 of the container base 110.

The windowed chamber 120 contains a kinetic game 170 as illustrated, for example, in FIGS. 1, 8, 13 and 14. In the illustrated embodiments, the windowed chamber 120 is sealed. The playing surface 135 of the windowed chamber 120 can feature a thematic or decorative presentation or template for the kinetic game, for example, the snowman illustrated in FIGS. 1, 8 and 13.

The illustrated kinetic games 170 include at least one movable member 140, which can be a ball, a cylinder, other spherical object, or a sliding block. The playing surface 135 can contain select features, such as recesses (or holes) 150, to receive and releasably retain the movable member 140. The playing surface 135 can also contain select features 220 that increase the difficulty of manipulation of the movable member 140, which features can be static, such as the walls of a maze 220, or baffled. There can be one or a plurality of movable members 140 and one or a plurality of such select features 150, 220.

The movable member 140 is physically manipulated by way of selective tilting of the playing surface 135 in a conventional manner. For example, in the embodiment illustrated in FIGS. 1, 8 and 13, the user manipulates five small balls 140 into five retaining depressions 150 forming the eyes and mouth of a snowman printed on the playing surface 135. In another embodiment illustrated in FIG. 14, the user manipulates a single ball 140 from one retaining depression 150*a* through a maze 220 to a second retaining depression 150*a*.

Figure 14:
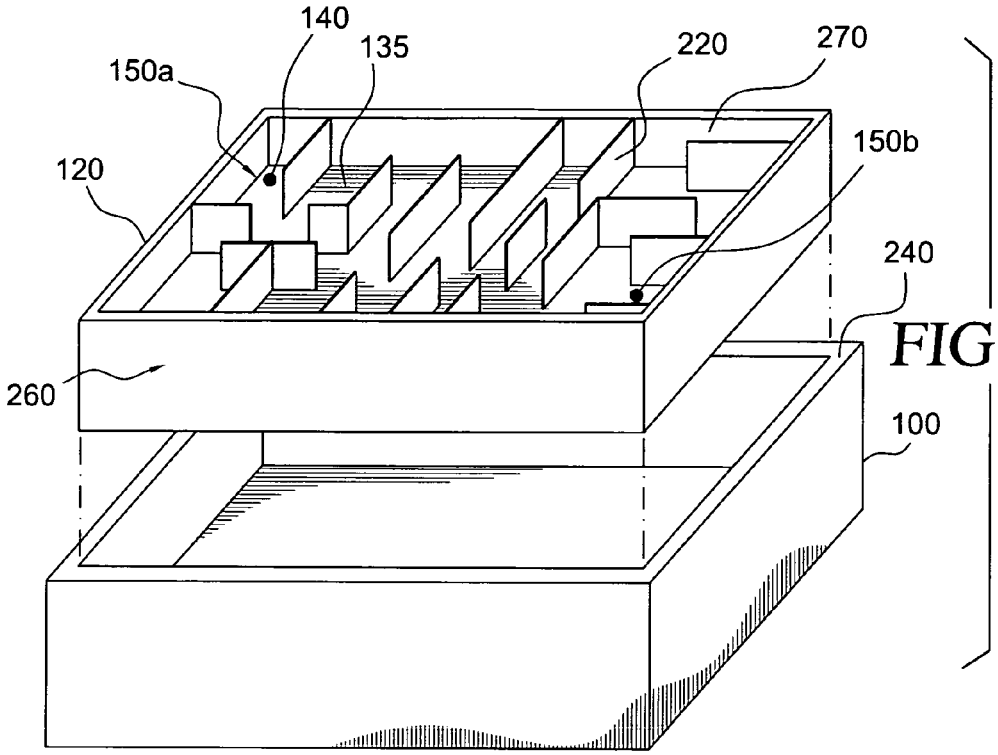
FIG. 14 is a close-up view of a further embodiment of the invention in which the windowed chamber has been removed from the container lid.

The kinetic game 170 can be manipulated by removing the windowed chamber 120 from the container. For example, FIG. 14 illustrates removal of the chamber 120 from the lid 100. Alternatively, the kinetic game 170 can be manipulated while the windowed chamber 120 remains attached to the container lid 100 as in FIG. 13. Further, the kinetic game 170 can be manipulated while the lid 100 and container base 110 are together, as in FIGS. 8, 11, 15, and 16.

Although specific embodiments of the invention have been described herein, it is understood by those skilled in the art that many other modifications and embodiments of the invention will come to mind to which the invention pertains, having benefit of the teaching presented in the foregoing description and associated drawings. It is, therefore, understood that the invention is not limited to the specific embodiments disclosed herein, and that many modifications and other embodiments of the invention are intended to be included within the scope of the invention. Moreover, although specific terms are employed herein, they are used only in generic and descriptive sense, and not for the purposes of limiting the described invention.

I claim:

1. A gift container, comprising:

a container base defining select planar dimensions formed by an upper and lower surface and a generally continuous rigid side wall of a first height and select thickness having inner and outer surfaces and projecting substantially orthogonally above said upper container base surface;

a lid, defining a cover with a lower surface and an upper surface dimensionally generally conforming to the planar dimension of the container base, said cover incorporating a depending perimeter side wall with an inner wall surface of a height equal to or less than the first height and dimensioned to slide over and register with the outer surface of the container base side wall;

a chamber incorporating a manipulable, kinetic game defining a playing surface, a generally continuous rigid side wall of a second height and select thickness having inner and outer surfaces projecting above said playing surface and forming an annulus with the perimeter wall and a viewing portion formed integrally with the outer surface of the container permitting user viewing of the underlying playing surface where the side wall of the chamber is continuous with the side wall of the container base; and at least one movable member disposed within the chamber for manipulation over said playing surface.

2. The gift container of claim 1 where the chamber side wall is affixed to the lower surface of the lid, the chamber is formed integrally with the lid, the lid cover is generally planar, and the viewing portion is transparent and the playing surface is disposed below the upper surface of the lid cover.

3. The gift container of claim 2 where the playing surface is generally parallel to and spaced from the upper surface of the container base.

4. The gift container of claim 3 where the playing surface contains select features for receiving said movable member.

5. The gift container of claim 4 where the select features are recesses adapted for releasably retaining said movable member.

6. The gift container according to claim 5 where the movable member is spherical.

7. The gift container of claim 6 including a plurality of movable members and a plurality of recesses corresponding in number to the plurality of movable members.

8. The gift container of claim 1 where the playing surface extends over the entire surface bordered by the side wall of the chamber.

9. The gift container of claim 1 where the chamber is formed integrally with the lid and the side wall of the lid projects substantially orthogonally from the playing surface.

10. The gift container of claim 9 where the annulus is substantially the same height as the side wall of the lid.

11. The gift container of claim 9 where the kinetic game is sealed within the lid.

12. The gift container of claim 11 where the kinetic game includes features formed on the playing surface that increase the difficulty of manipulation of the movable member.

13. The gift container of claim 12 where features are static.

14. The gift container of claim 13 where features are baffles.

15. A gift container, comprising:

a container base defining select planar dimensions formed by an upper and lower surface and a generally continuous rigid side wall of a first height and select thickness having inner and outer surfaces and projecting substantially orthogonally above said upper container base surface;

a lid, defining a cover with a lower surface and an upper surface dimensionally generally conforming to the planar dimension of the container base, said cover incorporating a depending perimeter side wall with an inner wall surface of a height equal to or less than the first height and dimensioned to slide over and register with the outer surface of the container base side wall;

a chamber formed integrally with the lid, said chamber incorporating a manipulable, kinetic game defining a playing surface disposed below the upper lid surface, a generally continuous side wall being continuous with the side wall of the container base, said generally continuous side wall being of a second height and select thickness having inner and outer surfaces and projecting above said playing surface and forming an annulus with the depending perimeter wall, the rigid side wall being affixed to the lower surface of the lid cover, and a viewing portion formed integrally with the outer surface of the container permitting user viewing of the underlying playing surface; and at least one movable member disposed within the chamber for manipulation over said playing surface.

16. A gift container comprising:

a container base having a bottom defining planar dimensions, and a side wall of a first height projecting substantially orthogonally above said bottom;

a lid having a top dimensionally generally conforming to the planar dimension of the bottom such that said lid is capable of frictional engagement of said container base, and a side wall depending from said top;

a chamber within an area defined by said container base and said lid, said chamber having a manipulable, kinetic game having a playing surface, and at least one movable member, a side wall projecting above said playing surface, said side wall being continuous with the container base side wall, and a viewing window formed with an outside surface of the container.

17. The gift container of claim 16 where said viewing window is integrally formed with the side wall of said container base.

18. The gift container of claim 16 where said viewing window is integrally formed with said top of said lid, and said side wall of said chamber is integrally formed with said side wall of said lid.

19. The gift container of claim 16 where said viewing window is integrally formed with said bottom of said container base.

20. The gift container of claim 16 where said at least one movable member includes a plurality of movable members, and said gift container further including a plurality of recesses corresponding in number to the plurality of movable members.

* * * * *